US005184672A

United States Patent [19]

Aoki

[11] Patent Number: 5,184,672

[45] Date of Patent: Feb. 9, 1993

[54] HEAT EXCHANGER

[75] Inventor: Hisao Aoki, Gunma, Japan

[73] Assignee: Sanden Corporation, Gunma, Japan

[21] Appl. No.: 802,239

[22] Filed: Dec. 4, 1991

[30] Foreign Application Priority Data

Dec. 4, 1990 [JP] Japan ..... 2-400079[U]

[51] Int. Cl.[5] ..... F28F 13/12

[52] U.S. Cl. ..... 165/109.1; 138/38

[58] Field of Search ..... 138/38; 165/109.1, 179, 165/916

[56] References Cited

U.S. PATENT DOCUMENTS

| | | | |
|---|---|---|---|
| 2,136,641 | 11/1938 | Smith | 165/152 X |
| 2,161,887 | 6/1939 | Ramsaur | 138/38 |
| 2,289,097 | 7/1942 | Brinen | 138/38 X |
| 2,359,288 | 10/1944 | Brinen | 138/38 |
| 2,819,731 | 1/1958 | Loughthan | 62/515 |
| 3,204,693 | 9/1965 | Kuhn | 165/111 |
| 3,274,797 | 9/1966 | Kritzer | 62/511 |
| 3,750,709 | 8/1973 | French | 138/38 |
| 3,920,069 | 11/1975 | Mosier | 165/150 |
| 4,089,324 | 5/1978 | Tjaden | 165/76 X |
| 4,899,812 | 2/1990 | Altoz | 165/109.1 |
| 4,945,981 | 8/1990 | Joshi | 165/109.1 |
| 4,998,508 | 3/1991 | Guntly | 165/133 |
| 5,029,636 | 7/1991 | Kadle | 165/109.1 |

FOREIGN PATENT DOCUMENTS

| | | |
|---|---|---|
| 57-198992 | 5/1981 | Japan . |
| 58-221390 | 6/1992 | Japan . |
| 566766 | 4/1942 | United Kingdom . |
| 1601954 | 6/1977 | United Kingdom . |
| 2059562 | 4/1981 | United Kingdom . |

*Primary Examiner*—Allen J. Flanigan
*Attorney, Agent, or Firm*—Baker & Botts

[57] ABSTRACT

A heat exchanger, such as a condenser, for use in an automobile air conditioning system comprises a plurality of flat tubes for conducting the refrigerant and a plurality of corrugated outer fins fixedly sandwiched between the flat tubes. First and second header pipes are fixedly and hermetically connected to the flat tubes and thereby communicate with the interior of the tubes. Each of the flat tubes includes a flat tube member and a corrugated inner fin. The corrugated inner fin includes a plurality of ridges which extend along the width of the flat tube member. The adjacent ridges are fixedly connected to upper and lower inner surfaces of the flat tube member so as to define a plurality of lateral hollow regions in an interior hollow portion of the flat tube member. A plurality of openings are formed in each of surfaces of the corrugated inner fin defined between the adjacent ridges so as to laterally disperse the flow of the refrigerant when the refrigerant flows through the interior hollow space of the flat tube. As a result, the heat exchange efficiency of the condenser is sufficiently improved while preventing expansion of the flat tube members.

7 Claims, 5 Drawing Sheets

HEAT EXCHANGER

BACKGROUND OF THE INVENTION

1. Field of the Invention

The present invention relates generally to heat exchangers, and more particularly, to a heat exchanger for use in an automotive air conditioning system.

2. Description of the Prior Art

One prior art embodiment of a heat exchanger as described in Japanese Patent Application Publication No. 2-154986 is essentially illustrated in FIGS. 1 and 2. As shown in the figures, a heat exchanger such as a condenser 100 includes a plurality of adjacent, essentially flat tubes 100 having oval cross-sections and open ends which allow refrigerant fluid to flow therethrough. A plurality of corrugated outer fin units 120 are fixedly disposed between adjacent tubes 110. Cylindrical header pipes 130 and 140 having closed ends are disposed perpendicular to flat tubes 110. Flat tubes 110 having open ends are fixedly and hermetically connected to the inside of header pipes 130 and 140, so as to communicate with the hollow interiors of header pipes 130 and 140.

Inlet pipe 131 has an open end which is fixedly and hermetically connected to the outside of an upper portion of header pipe 130. The other open end of inlet pipe 131 is linked to an outlet of an element (not shown) positioned upstream with respect to condenser 100. The element may be, for example, a compressor. Outlet pipe 141 also has an open end which is fixedly and hermetically connected to the outside of a lower portion of header pipe 140. The other open end of outlet pipe 141 is linked to an inlet of an element (not shown) positioned downstream with respect to condenser 100. This element could be, for example, a receiver.

With reference to FIG. 2, each flat tube 110 includes flat tube member 111 and a plurality of partition walls 112. Partition walls 112 are integrally formed along an inner surface of flat tube member 111. Partition walls 112 extend longitudinally along the length of flat tube member 111 so as to divide the interior hollow portion of flat tube member 111 into a plurality of rectangular parallelepiped hollow regions 113 and a pair of semicylindrical hollow regions 114 which are located at the lateral ends of flat tube member 111. Hollow regions 113 and 114 extend in parallel directions with respect to one another. As discussed below, the hollow regions extend transversely relative to a flow direction "A" of the air. The air flows along the exterior surface of the flat tube 110.

During operation of a refrigerant circuit which includes condenser 100, the discharged refrigerant gas from a compressor is directed into the hollow interior of header pipe 130 via inlet pipe 131. The refrigerant gas directed into the hollow interior of header pipe 130 flows through the hollow interior of header pipe 130 toward its lower end. The refrigerant gas flowing through the hollow interior of header pipe 130 concurrently flows into each of the hollow regions 113 and 114 of each of flat tubes 110. The gas then longitudinally flows through each of hollow regions 113 and 114 of each of the flat tubes 110 from the right to the left sides (in FIG. 1). The refrigerant gas exchanges heat with air passing along corrugated fins 120 so as to be liquefied. The flow direction of the air passing along corrugated fins 120 is shown by large arrow "A" in FIG. 2. Accordingly, the air laterally passes along an exterior surface of flat tubes 110. Finally the refrigerant flows out from each of the hollow regions 113 and 114 of each of flat tubes 110. The liquefied refrigerant flowing out from each of hollow regions 113 and 114 of each flat tube 110 joins together at the hollow interior of header pipe 140, and flows through the hollow interior of header pipe 140 toward a lower end of header pipe 140. The liquefied refrigerant flowing through the hollow interior of header pipe 140 is conducted to the receiver via outlet pipe 141.

In this prior art embodiment, the integral formation of the partition walls 112 prevents expansion of flat tube members 111 caused by the pressure force of the refrigerant. Further, the area of the contact surface between the refrigerant and the flat tube 110 is increased so that a heat exchange efficiency of condenser 100 is improved.

FIG. 3 essentially illustrates one of a plurality of identical flat tubes 210 which form a part of a condenser (not shown) as described in U.S. Pat. No. 4,998,580. As shown in the figure, flat tube 210 includes flat tube member 211 and corrugated inner fin 212. Inner fin 212 is fixedly disposed along the entire interior length of the hollow portion of flat tube member 211. Corrugated inner fin 212 includes a plurality of ridges **212*a* which longitudinally extend along the length of flat tube member 211. Adjacent ridges 212*a* are fixedly connected to upper and lower inner surfaces of flat tube member 211, respectively, so as to define a plurality of hollow regions 213. The hollow regions have a lateral cross section which is defined by the generally sine curve shape of fin 212, in the interior hollow portion of flat tube member 211. Hollow regions 213 are aligned with one another in a parallel relationship. Hollow regions 213 are oriented to extend transversely to the flow direction "A" of the air. The air passes along the exterior surface of the flat tube 210**.

In this prior art embodiment, the attachment of the separately formed corrugated inner fin 212 to flat tube member 211 effectively prevents the expansion of flat tube member 211 caused by the pressure of the refrigerant, without unnecessarily increasing the thickness of flat tube member 211. Furthermore, the heat exchangeability of the condenser is improved because the refrigerant contacts a surface of corrugated inner fin 212 which conducts the heat to flat tube member 211.

In the prior art embodiments, the amount of heat exchange between the refrigerant and the air at the upstream side (relative to the air flow) the flat tube is large, while the amount of heat exchange between the refrigerant and the air at the downstream side (relative to air flow) region of the flat tube is small. This difference results because the refrigerant flows only longitudinally through each of the hollow portions of the flat tube; that is, the refrigerant does not disperse in the lateral direction when it flows through the interior hollow space of the flat tube. Therefore, the amount of heat exchange between the refrigerant flowing through the interior hollow space of the flat tube and the air laterally passing along the exterior surface of the flat tube is gradually decreased in the direction from the upstream side (relative to the air flow) region of the flat tube to the downstream side (relative to the air flow) region of the flat tube. Accordingly, the heat exchange efficiency of the condenser is not sufficiently improved by the divided construction.

SUMMARY OF THE INVENTION

Accordingly, it is an object of the present invention to improve the heat exchange efficiency of a heat exchanger while preventing an expanding transformation of the flat tubes of the heat exchanger.

The heat exchanger includes a plurality of flat tubes for making the refrigerant flow therethrough. Each of the flat tubes includes a flat tube member over the exterior surface of which the air laterally flows along, and a corrugated inner fin which is disposed in an interior hollow portion of the flat tube member. The corrugated inner fin includes a plurality of ridges which laterally extend in the interior hollow portion of the flat tube member. The adjacent ridges are fixedly connected to upper and lower inner surfaces of the flat tube member, respectively, so as to define a plurality of lateral hollow regions in the interior hollow portion of the flat tube member. A plurality of openings are formed along each of the surfaces defined by the inner fin to permit the longitudinal flow of the refrigerant through the tube.

DETAILED DESCRIPTION OF THE PREFERRED EMBODIMENTS

In all of the below-described embodiments of the present invention, only one flat tube of a condenser or only one inner corrugated fin which forms a part of a flat tube of a condenser will be discussed. The overall construction of the condenser of each of the embodiments is preferably similar to the overall construction of the prior art condenser shown in FIG. 1. Therefore, the overall construction of the condenser of each of the embodiments is illustrated by FIG. 1.

Figure 4:
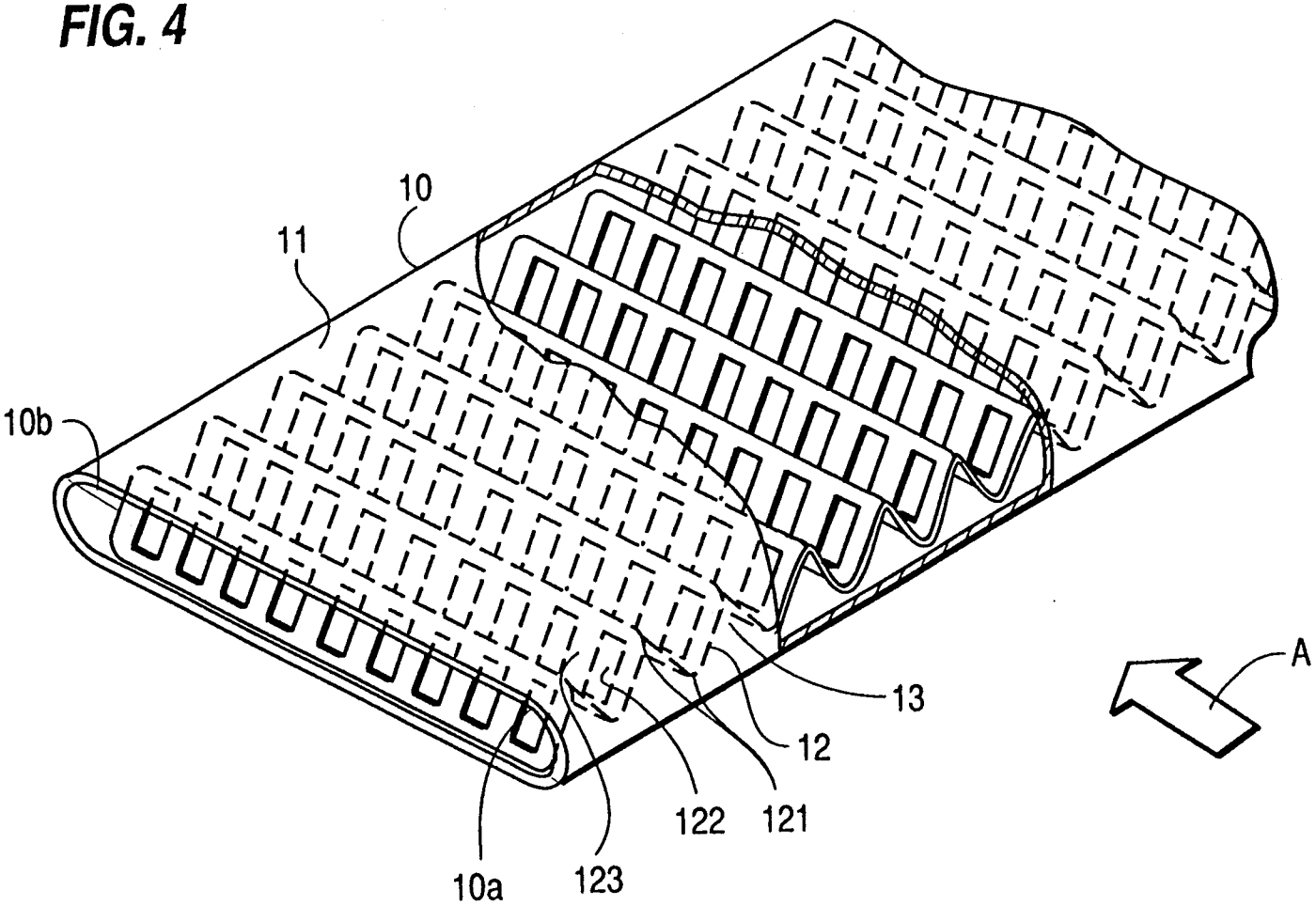
FIG. 4 illustrates a partial perspective diagram of a flat tube of a condenser in accordance with a first embodiment of the present invention.

With reference to FIG. 4, which illustrates a partial perspective diagram of a flat tube of a condenser in accordance with a first embodiment of the present invention, flat tube 10 includes a flat tube member 11 and a corrugated inner fin 12. Inner fin 12 is fixedly disposed throughout the entire interior hollow portion of flat tube member 11. Corrugated inner fin 12 includes a plurality of ridges 121 which extend along almost the entire width of flat tube member 11. Adjacent ridges 121 are fixedly connected to the upper and lower inner surfaces of flat tube member 11, respectively by, for example, brazing so as to define a plurality of hollow regions 13. The lateral cross section of each hollow region 13 has a generally triangular or sine curve shaped configuration, in the interior hollow portion of flat tube member 11. Hollow regions 13 are aligned so as to be parallel to one another as well as to the flow direction "A" of the air which laterally passes along an exterior surface of the flat tube 10. A plurality of rectangular openings 122 are formed in each of the surfaces 123 which are defined between adjacent lower and upper ridges 121. Therefore, rectangular openings 122 defined in the same fin surface are aligned with one another in a direction parallel to the flow direction "A" of the air.

Figure 1:
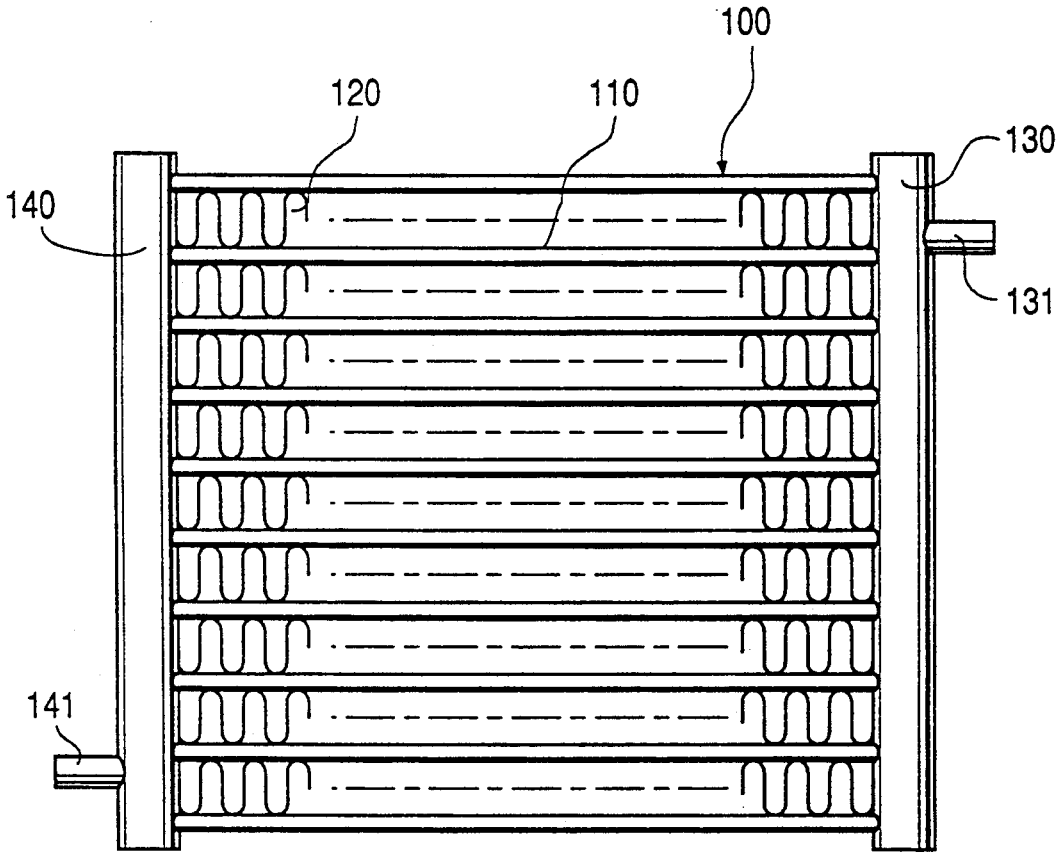
FIG. 1 PRIOR ART
FIG. 1 illustrates a front view of a condenser in accordance with one prior art embodiment.
Figure 2:
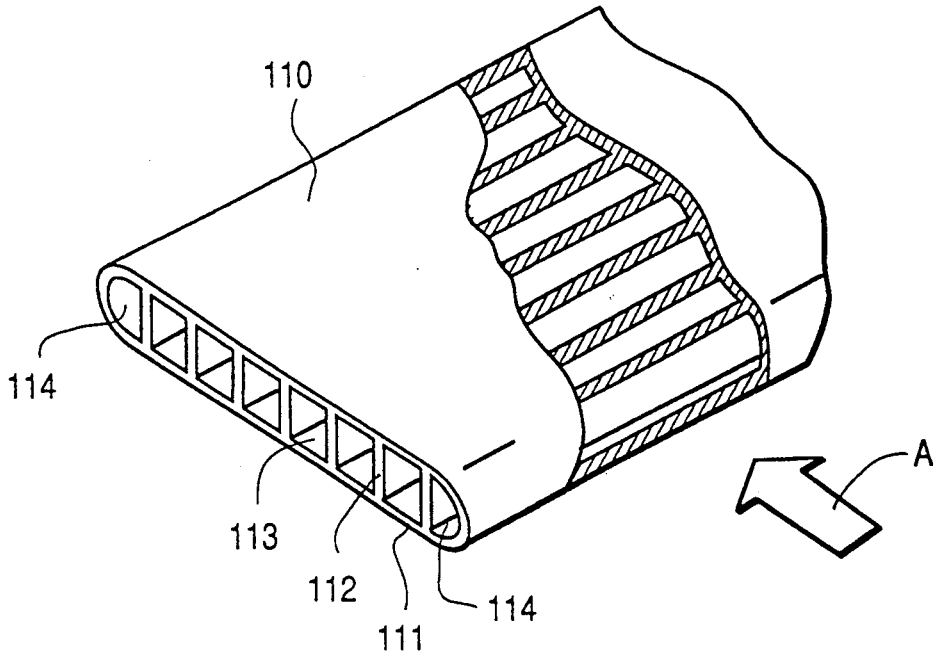
FIG. 2 PRIOR ART
FIG. 2 illustrates a partial perspective view of a flat tube shown in FIG. 1.
Figure 3:
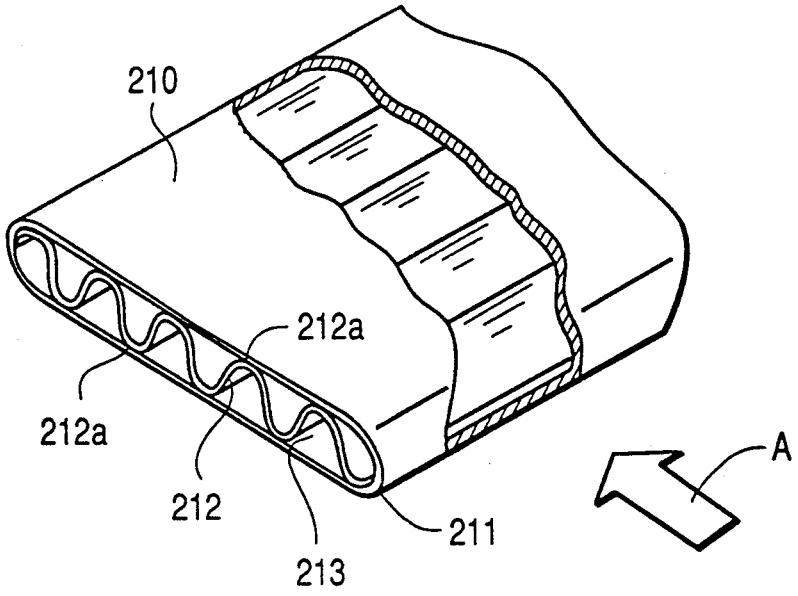
FIG. 3 PRIOR ART
FIG. 3 illustrates a partial perspective view of a flat tube of a condenser in accordance with another prior art embodiment.

With reference to FIGS. 1 and 4, during operation of a refrigerant circuit which includes condenser 10, the discharged refrigerant gas from the compressor is conducted into the hollow interior of header pipe 130 via inlet pipe 131. The refrigerant gas conducted into the hollow interior of header pipe 130 flows through the hollow interior of header pipe 130 toward a lower end of header pipe 130. The refrigerant gas flowing through the hollow interior of header pipe 130 concurrently flows into the interior hollow space of each of flat tubes 10. The refrigerant gas flowing into the interior hollow space of each flat tube 10 longitudinally flows through the interior hollow space of the flat tube 10 from the right to the left sides (in FIG. 1) through rectangular openings 122. As the refrigerant flows through flat tube 10, it exchanges heat with air laterally passing along an exterior surface of each of flat tubes 10 so as to be liquefied.

When the refrigerant flows through the interior hollow space of flat tube 10, certain portions of the refrigerant flows laterally, through each of the hollow regions 13, toward both the upstream side (relative to the air flow) region 10*a* of flat tube 10 and the downstream side (relative to air flow) region 10*b* of flat tube 10. In other words, the flow path of the refrigerant is laterally dispersed when the refrigerant longitudinally flows through the interior hollow space of flat tube 10. Therefore, the gradual decline of the amount of heat exchange between the refrigerant longitudinally flowing through the interior hollow space of flat tube 10 and the air laterally passing along the exterior surface of flat tube 10 in the direction from the upstream side (relative to the air flow) region 10*a* of flat tube 10 to the downstream side (relative to air flow) region 10*b* of flat tube 10 heretofore experienced can be significantly reduced. As a result, the heat exchange efficiency of the condenser is improved in comparison with the condensers discussed in the prior art section of this specification.

Thereafter the liquefied refrigerant flows out from the interior hollow space of each flat tube 10. The liquefied refrigerant flowing out from the interior hollow space of each flat tube 10 joins together in the hollow interior of header pipe 140 and flows through the hollow interior of header pipe 140 toward a lower end of header pipe 140. The liquefied refrigerant flowing through the hollow interior of header pipe 140 is conducted to a receiver via outlet pipe 141. In this embodiment, the attachment of the inner fin member effectively prevents an expanding transformation of flat tube member 11 caused by pressure force of the refrigerant.

Figure 5:
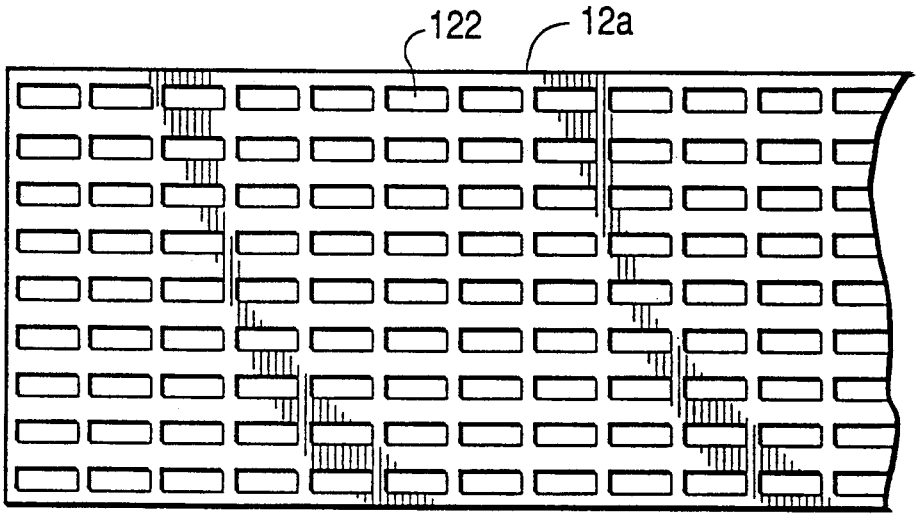
FIG. 5 illustrates a partial development of a corrugated inner fin shown in FIG. 4.

The process of forming a corrugated inner fin 12 is separately carried out from the process of forming flat tube member 11. With reference to FIGS. 4 and 5, a plurality of rectangular openings 122 are first punched out from a metal sheet which could, for example, be an aluminum alloy sheet. Then, the punched out metal sheet 12*a* is corrugated by using a well known corrugating machine (not shown). When the punched out metal sheet 12*a* is corrugated, ridges 121 are positioned on a line which is located between the adjacent ranks (i.e., the lateral rows) of rectangular openings 122. When the process of forming inner corrugated fins 12 is completed, a plurality of inner corrugated fins 12 are inserted into the interior hollow portions of a plurality of flat tube members 11. Inner fins 12 are inserted so as to be disposed throughout the entire interior hollow portion of each of the flat tube members 11. Finally, adjacent ridges 121 are fixedly connected to the upper and lower inner surfaces of flat tube member 11, respectively by, for example, brazing.

Figure 6:
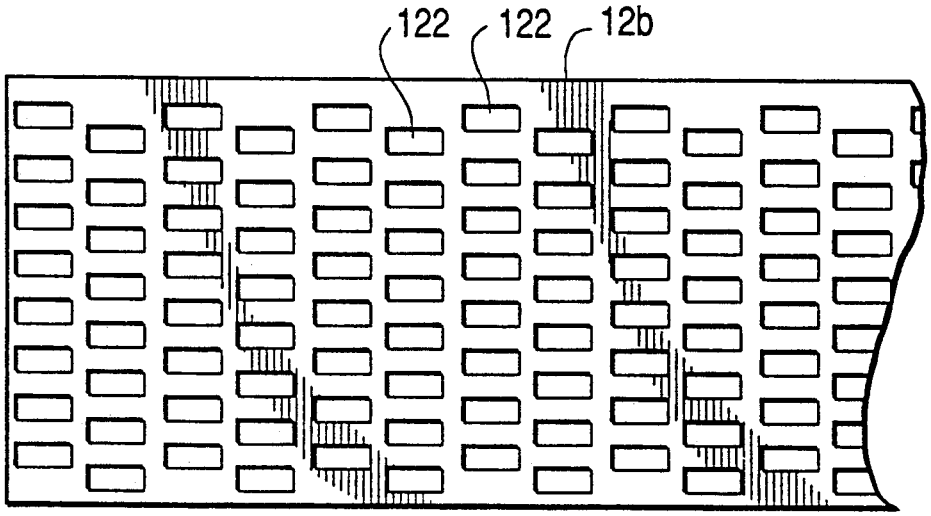
FIG. 6 illustrates a partial development of a corrugated inner fin of a flat tube of a condenser in accordance with a second embodiment of the present invention.

FIG. 6 illustrates a punched out metal sheet 12*b* which is to be corrugated for fabricating an inner fin of a flat tube of a condenser in accordance with a second embodiment of the present invention. In this embodiment, rectangular openings 122 of adjacent ranks are offset from one another. Therefore, when the refrigerant flows through the rectangular openings 122 defined in interior hollow space of flat tube 10 the turbulence of the refrigerant is further enhanced. Therefore, the heat exchange efficiency of the condenser is even further improved in comparison with the condenser of the first embodiment of the present invention.

Figure 7:
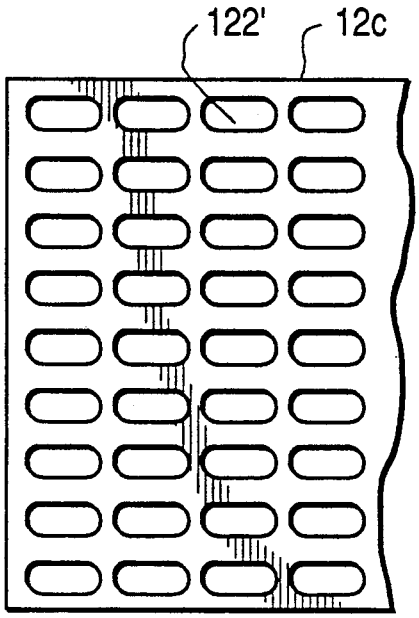
FIG. 7 illustrates a partial development of a corrugated inner fin of a flat tube of a condenser in accordance with a third embodiment of the present invention.
Figure 8:
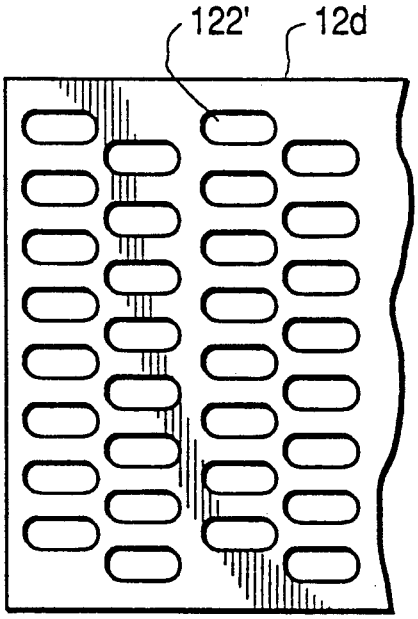
FIG. 8 illustrates a partial development of a corrugated inner fin of a flat tube of a condenser in accordance with a fourth embodiment of the present invention.

FIGS. 7 and 8 illustrate a punched out metal sheets 12*c* and 12*d* which are prepared to be corrugated for fabricating an inner fin of a flat tube of a condenser in accordance with third and fourth embodiments of the present invention, respectively. In the figures, rectangular openings 122 as shown in FIGS. 5 and 6 are replaced with oval-shaped openings 122'.

Furthermore, rectangular openings 122 or oval-shaped openings 122' may be punched out when the metal sheet is corrugated by using another well known corrugating machine (not shown).

Moreover, in all of the embodiments of the present invention, the lateral dispersion of the refrigerant flow caused by the inclusion of the corrugated inner fin in the interior hollow space of the flat tube results in a negligible value of additional fluid resistance between the corrugated inner fin and the refrigerant as compared to the prior art.

This invention has been described in detail in connection with the preferred embodiments. These embodiments, however, are merely for example only and the invention is not restricted thereto. It will be understood by those skilled in the art that other variations and modifications can easily be made within the scope of this invention as defined by the claims.

I claim:

1. In a heat exchanger including pipe means for directing a first fluid to flow therethrough, the improvement comprising dispersing means for dispersing the flow of the first fluid when the first fluid flows through said pipe means, wherein said pipe means includes at least one flat tube member over the exterior of which a second fluid laterally flows, and wherein said dispersing means includes a corrugated fin which is disposed in an interior hollow portion of said at least one flat tube member, said corrugated fin including a plurality of ridges which extend laterally in said interior hollow portion of said flat tube member and a plurality of surfaces defined between each pair of adjacent ridges, said adjacent ridges being fixedly connected to upper and lower inner surfaces of said flat tube member so as to define a plurality of lateral hollow regions in said interior hollow portion of said flat tube member, a plurality of openings being formed in each of said surfaces defined between said adjacent ridges to facilitate flow of the first fluid through said at least one tube member.

2. The heat exchanger of claim 1 wherein said openings are rectangular.

3. The heat exchanger of claim 1 wherein said openings are oval-shaped.

4. The heat exchanger of claim 3 wherein said openings are defined in lateral and longitudinal rows such that the openings in each row are aligned with one another.

5. The heat exchanger of claim 3 wherein said openings are defined in lateral rows such that openings in adjacent rows are laterally offset from one another.

6. A heat exchanger comprising at least one tubular member having an inner surface and an outer surface, said inner surface defining a flow path through which a first fluid is passed to achieve a heat exchange between said first fluid in said tubular member and a second fluid which passes over said outer surface of said tubular member, said tubular member further defining an internal structure for dispersing portions of said first fluid laterally in said tubular member when said first fluid flows therethrough, wherein said internal structure includes a plurality of laterally arranged barriers within said tubular member, wherein each said barrier defines a plurality of openings to permit said first fluid to flow therethrough, and wherein each said opening is laterally aligned with the other openings defined in the same barrier and is longitudinally offset with the openings defined in each of the barriers adjacent thereto.

7. A heat exchange tube in a heat exchanger comprising a tubular member having an internal surface defining a flow path for receiving a first fluid therethrough and an external surface over which a second fluid flows to facilitate a heat exchange between said first and second fluids, said tubular member further including an internal structure in said flow path, said internal structure functioning to disperse said first fluid laterally within said tubular member as said first fluid flows along said flow path, wherein said internal structure includes a plurality of barriers, wherein each barrier defines a plurality of openings therein, and each said barrier is arranged to extend generally laterally with respect to said tubular member and in which said barriers are longitudinally spaced apart from one another to define spaces in which said fluid is laterally dispersed, and wherein each said opening in each of said barriers is longitudinally offset from the openings in said adjacent barriers.

* * * * *